US008098205B2

(12) United States Patent
Rabinovich et al.

(10) Patent No.: US 8,098,205 B2
(45) Date of Patent: Jan. 17, 2012

(54) GPS, GSM, AND WIRELESS LAN ANTENNA FOR VEHICLE APPLICATIONS

(75) Inventors: Victor Rabinovich, Richmond Hill (CA); Michael Matkiwsky, Whitby (CA)

(73) Assignee: Flextronics Automotive Inc., Ontatio (CA)

( * ) Notice: Subject to any disclaimer, the term of this patent is extended or adjusted under 35 U.S.C. 154(b) by 444 days.

(21) Appl. No.: 12/435,750

(22) Filed: May 5, 2009

(65) Prior Publication Data

US 2010/0283684 A1 Nov. 11, 2010

(51) Int. Cl.
*H01Q 1/32* (2006.01)

(52) U.S. Cl. ..... 343/713; 343/700 MS; 343/895

(58) Field of Classification Search ..... 343/700 MS, 343/711, 713, 876, 895
See application file for complete search history.

(56) References Cited

U.S. PATENT DOCUMENTS 6,326,921 B1 * 12/2001 Egorov et al. ..... 343/700 MS
6,856,285 B2 * 2/2005 Bettin et al. ..... 343/700 MS
7,319,432 B2 * 1/2008 Andersson ..... 343/702
7,412,255 B2 8/2008 Klemetti et al.
7,605,766 B2 * 10/2009 Dahlstrom et al. ..... 343/702
7,847,736 B2 * 12/2010 Channabasappa ..... 343/700 MS
7,973,736 B2 * 7/2011 Tucek et al. ..... 343/895
2005/0041624 A1 2/2005 Hui et al.
2007/0152881 A1 7/2007 Chan
2007/0229381 A1 10/2007 Piisila
2008/0048929 A1 2/2008 Channabasappa

* cited by examiner

*Primary Examiner* — Tho G Phan
(74) *Attorney, Agent, or Firm* — Patton Boggs LLP

(57) ABSTRACT

A Global Positioning System (GPS), Global System for Mobile Communications (GSM), wireless local area network (WLAN) antenna, including a dielectric board including a ground plane; a first antenna trace line disposed on a first portion of the dielectric board and in electrical contact with the dielectric board, the first antenna trace line including at least one first meandered trace for transmitting and receive a WLAN radio frequency signal; a second antenna trace line disposed on a second portion of the dielectric board and in electrical contact with the dielectric board, the second antenna trace line including at least one second meandered trace for transmitting and receiving a GSM radio frequency signal; a GPS antenna for receiving radio frequency signals from at least one global positioning satellite; and a vehicle mountable housing for enclosing the dielectric board, the first antenna trace line, the second antenna trace line, and the GPS antenna.

26 Claims, 9 Drawing Sheets

900

| 1: Mkr (MHz) | | Ohm | Ohm | 2: Mkr (MHz) | dB |
|---|---|---|---|---|---|
| 1: | 824.000 | 22.96 | 2.600 | | |
| 2: | 960.000 | 91.45 | 33.62 | | |
| 3: | 1710.000 | 35.78 | 17.64 | | |
| 4: | 2039.967 | 34.73 | -24.78 | | |
| 5: | 2380.767 | 24.90 | 1.584 | | |
| 6: | 2462.767 | 34.93 | -23.84 | | |

GPS, GSM, AND WIRELESS LAN ANTENNA FOR VEHICLE APPLICATIONS

BACKGROUND

Without limiting the scope of the invention, its background will be described in relation to an antenna for a vehicle to communicate with a Global Positioning System ("GPS"), Global System for Mobile Communications ("GSM"), and wireless local area network ("WLAN") systems, as an example.

Wireless communication systems are widely deployed in vehicles to provide various communication services such as voice, data, and so on. These wireless systems may be based on Code Division Multiple Access ("CDMA"), Time Division Multiple Access ("TDMA"), Frequency Division Multiple Access ("FDMA"), or some other multiple-access techniques. A wireless system may implement one or more standards adopted by a standards group or consortium, such as IS-2000, IS-856, IS-95, GSM, Wideband-CDMA ("W-CDMA"), and so on.

A vehicle equipped with wireless communication device (s), such as a cellular or mobile phone, may utilise a transceiver system to obtain two-way communications with a particular wireless system. The transceiver system may include a transmitter for data transmission and a receiver for data reception. On a transmit path, the transmitter may modulate a radio frequency ("RF") carrier signal with data to produce a RF modulated signal that is more suitable for transmission from the vehicle. Further, the transmitter may condition the RF modulated signal to generate an RF uplink signal and then transmit the RF uplink signal via a wireless channel to one or more base stations in a particular wireless system. On a receive path, the receiver may receive one or more RF downlink signals from one or more base stations, and condition and process the received signal to obtain data sent by the base station(s).

Some vehicles are equipped with a multi-mode wireless device, such as a dual-mode cellular phone, which may be capable of communicating with multiple wireless systems (e.g., GSM and CDMA systems). This capability allows the multi-mode device to receive communication services from more systems and enjoy greater coverage provided by these systems. A multi-mode transceiver may have many signal paths to support all of the frequency bands used by all of the wireless systems. Interconnecting all of these signal paths to the antenna may require a complicated transmitter/receiver ("T/R") switch with many input/output ("I/O") RF ports. Additionally, multi-mode wireless system have different and separate antennas for each wireless system it is communicating with, thus creating large and complex arrays of antennas housed together or separately that are not aesthetically pleasing.

SUMMARY

The above-described problems are solved and a technical advance is achieved by the GPS, GSM, and WLAN antenna for vehicle applications ("GPS, GSM, and WLAN antenna") disclosed in this application. The GPS, GSM, and WLAN antenna may be used for GPS positioning information, wireless cellular communications, and wireless internet data transmissions, for example. More specifically, the GPS, GSM, and WLAN antenna includes a housing for two different multiband antennas disposed on a single printed circuit board ("PCB") and a GPS antenna for use in vehicle applications.

In one embodiment, the present GPS, GSM, WLAN antenna includes a dielectric board including a ground plane; a first antenna trace line disposed on a first portion of the dielectric board and in electrical contact with the dielectric board, the first antenna trace line including at least one first meandered trace for transmitting and receiving a WLAN radio frequency signal; a second antenna trace line disposed on a second portion of the dielectric board and in electrical contact with the dielectric board, the second antenna trace line including at least one second meandered trace for transmitting and receiving a GSM radio frequency signal; a GPS antenna for receiving radio frequency signals from at least one global positioning satellite; and a vehicle mountable housing for enclosing the dielectric board, the first antenna trace line, the second antenna trace line, and the GPS antenna.

In one aspect, the GPS, GSM, WLAN antenna further includes a first output in contact with the first antenna trace line; a second output in contact with the second antenna trace line; and a third output in contact with the GPS antenna for outputting electrical signals to at least one transceiver via a RF cable. In another aspect, the GPS, GSM, WLAN antenna further includes a switch in contact with the first output and second output for switching between the GSM radio frequency signal and the WLAN radio frequency signal for providing the GSM radio frequency signal to a GSM transceiver and the WLAN radio frequency signal to a WLAN transceiver. In addition, the transmitting and receiving of GSM radio frequency may be time division multiple access. Also, the first antenna trace line may be capable of receiving 900 MHz, 1800 MHz, 850 MHz, and 1900 MHz radio frequency signals. Further, the second antenna trace line may be capable of receiving 2.4 GHz radio frequency signals.

In another aspect, the GPS antenna is capable of receiving one of 1.57542 GHz and 1.2276 GHz radio frequency signals. In yet another aspect, the second antenna trace line includes a first antenna trace line portion having a length of 10 mm and a width of 2 mm, the first antenna trace line portion extending laterally from a base of the housing; a second antenna trace line portion having a length of 40 min and a width of 7 mm, the second antenna trace line portion extending laterally from the first antenna trace line portion; a third antenna trace line portion having a length of 9 mm and a width of 17 mm, the third antenna trace line portion extending substantially longitudinally from the second antenna trace line portion; a fourth antenna trace line portion having a length of 8 mm and a width of 3 mm, the fourth antenna trace line portion extending laterally from the third antenna trace line portion towards the base of the housing; and a fifth antenna trace line portion having a length of 2 mm and a width of 3 mm, the fifth antenna trace line portion extending longitudinally from the fourth antenna trace line portion toward the first antenna trace line portion.

In still yet another aspect, the first antenna trace line has a length of 24 mm and a width of 5 mm, the second antenna trace line extending laterally from a base of the housing. Additionally, the first antenna trace line includes a first antenna trace line and a second antenna trace line spaced apart to define a GSM antenna portion between the first antenna trace line and the second antenna trace line, the first and second antenna trace line having a length of 36 mm and a width of 5 mm, the first and second antenna trace line extending laterally from a base of the housing. Further, the second antenna trace line includes a first plurality of meander trace antenna lines disposed between the first antenna trace line and the second antenna trace line; and a second plurality of meander antenna trace lines not disposed between the first antenna trace line and the second antenna trace line, wherein the first plurality of meander trace antenna lines have a width of 15 mm and a length 2 mm, and the second plurality of meander trace antenna lines have a width of 20 mm and a length of 2 mm. Also, the dielectric board may be a FR-4 dielectric substrate. In addition, the GPS, GSM, WLAN antenna may further include a satellite digital audio radio antenna.

In another embodiment, the present invention includes a vehicle having a GPS, GSM, WLAN antenna, including a vehicle body; a dielectric board including a ground plane; a first antenna trace line disposed on a first portion of the dielectric board and in electrical contact with the dielectric board, the first antenna trace line including at least one first meandered trace for transmitting and receiving a WLAN radio frequency signal; a second antenna trace line disposed on a second portion of the dielectric board and in electrical contact with the dielectric board, the second antenna trace line including at least one second meandered trace for transmitting and receiving a GSM radio frequency signal; a GPS antenna for receiving radio frequency signals from at least one global positioning satellite; and a housing mounted on the vehicle body for enclosing the dielectric board, the first antenna trace line, the second antenna trace line, and the GPS antenna.

In one aspect, the vehicle further includes a first output in contact with the first antenna trace line; a second output in contact with the second antenna trace line; and a third output in contact with the GPS antenna for outputting electrical signals to at least one transceiver via a RF cable. In another aspect, the vehicle further includes a switch in contact with the first output and second output for switching between the GSM radio frequency signal and the WLAN radio frequency signal for providing the GSM radio frequency signal to a GSM transceiver and the WLAN radio frequency signal to a WLAN transceiver. In yet another aspect, the transmitting and receiving of GSM radio frequency is time division multiple access. Also, the first antenna trace line is capable of receiving 900 MHz, 1800 MHz, 850 MHz, and 1900 MHz radio frequency signals. In another aspect, the second antenna trace line is capable of receiving one of 2.4 GHz radio frequency signals.

Preferably, the GPS antenna is capable of receiving one of 1.57542 GHz and 1.2276 GHz radio frequency signals. Also preferably, the second antenna trace line includes a first antenna trace line portion having a length of 10 mm and a width of 2 mm, the first antenna trace line portion extending laterally from a base of the housing; a second antenna trace line portion having a length of 40 mm and a width of 7 mm, the second antenna trace line portion extending laterally from the first antenna trace line portion; a third antenna trace line portion having a length of 9 mm and a width of 17 mm, the third antenna trace line portion extending substantially longitudinally from the second antenna trace line portion; a fourth antenna trace line portion having a length of 8 mm and a width of 3 mm, the fourth antenna trace line portion extending laterally from the third antenna trace line portion towards the base of the housing; and a fifth antenna trace line portion having a length of 2 mm and a width of 3 mm, the fifth antenna trace line portion extending longitudinally from the fourth antenna trace line portion toward the first antenna trace line portion.

In another aspect, the first antenna trace line has a length of 24 mm and a width of 5 mm, the second antenna trace line extending laterally from a base of the housing. In addition, the first antenna trace line includes a first antenna trace line and a second antenna trace line spaced apart to define a GSM antenna portion between the first antenna trace line and the second antenna trace line, the first and second antenna trace line having a length of 36 mm and a width of 5 mm, the first and second antenna trace line extending laterally from a base of the housing. Further, the second antenna trace line includes a first plurality of meander trace antenna lines disposed between the first antenna trace line and the second antenna trace line; and a second plurality of meander antenna trace lines not disposed between the first antenna trace line and the second antenna trace line, wherein the first plurality of meander trace antenna lines have a width of 15 mm and a length 2 mm, and the second plurality of meander trace antenna lines have a width of 20 mm and a length of 2 mm. In yet another aspect, the dielectric board is a FR-4 dielectric substrate. In addition, the vehicle may further include a satellite digital audio radio antenna.

BRIEF DESCRIPTION OF THE DRAWINGS

For a more complete understanding of the features and advantages of the GPS, GSM, and WLAN antenna, reference is now made to the detailed description of the invention along with the accompanying figures in which corresponding numerals in the different figures refer to corresponding parts and in which.

DETAILED DESCRIPTION OF THE DRAWINGS

The term "exemplary" is used herein to mean "serving as an example, instance, or illustration." Any embodiment, aspect, or design described herein as "exemplary" is not necessarily to be construed as preferred or advantageous over other embodiments, aspects, or designs.

Figure 1:
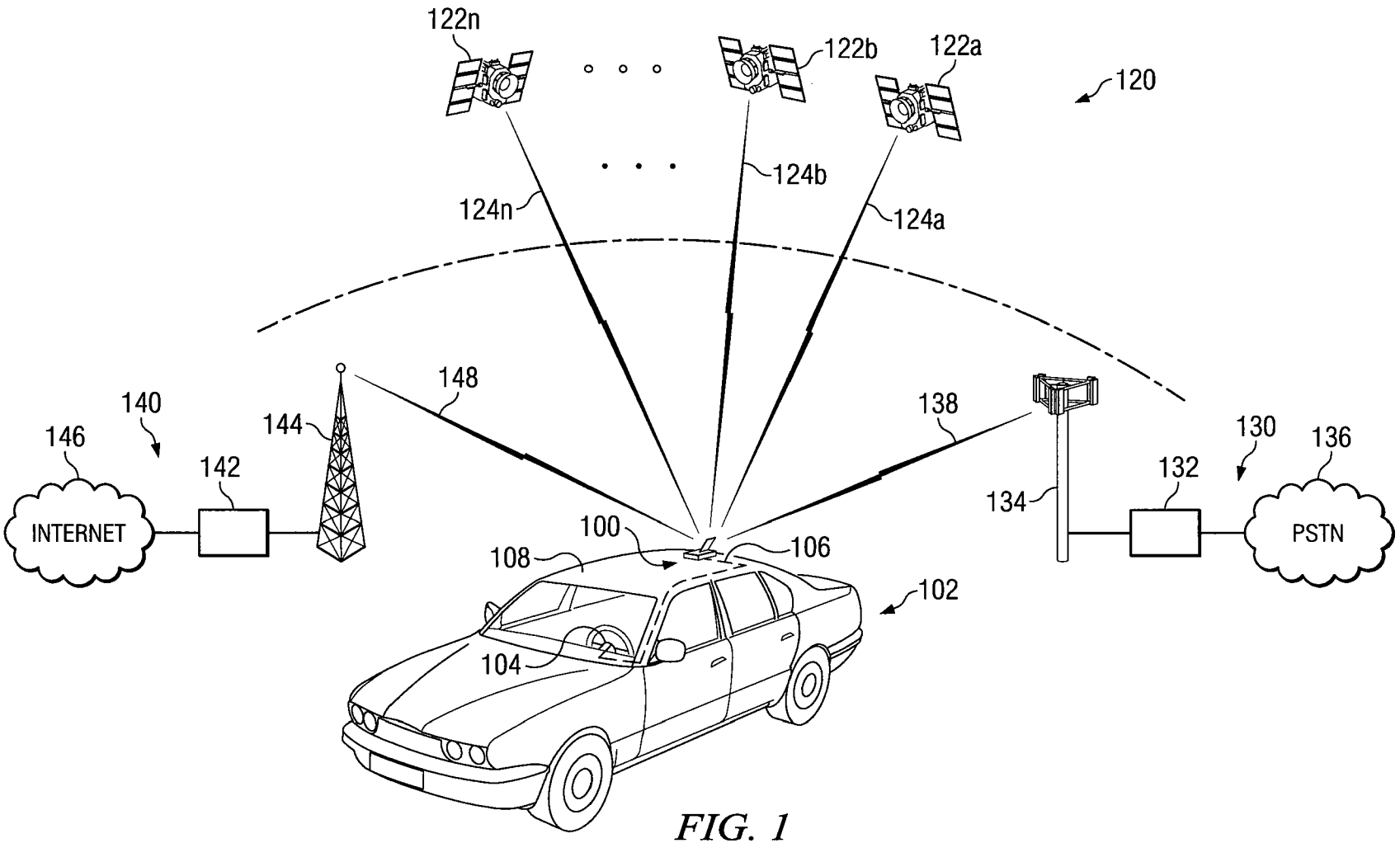
FIG. 1 is an illustration of an exemplary vehicle including a GPS, GSM, and WLAN antenna according to one embodiment.

FIG. 1 is an illustration of an exemplary vehicle 102 including a GPS, GSM, and WLAN antenna 100 disposed on the roof 108 of vehicle 102 capable of communicating with multiple systems. Preferably, GPS, GSM, and WLAN antenna 100 is capable of communicating with a GPS 120, a GSM 130, and a WLAN system 140. Additionally, GPS, GSM, and WLAN antenna 100 includes a transceiver 104 via a conductor 106 for communicating signals between GPS, GSM, and WLAN antenna 100 and transceiver 104. Transceiver 104 may be incorporated within GPS, GSM, and WLAN antenna 100 or it may be located in a separate location of vehicle 102, such as that shown in FIG. 1

GPS 120 includes a plurality of GPS satellites 122*a*-122*n* (collectively 122) that may be in orbit around the earth. A GPS antenna 304 (FIG. 3) has line-of-sight to one or more GPS satellites 122 from any location on Earth unless blocked by objects (e.g., buildings, trees, mountains, and so on). A GPS receiver 406 (FIG. 4) may obtain a three-dimensional ("3-D") position fix based on measurements for at least three GPS satellites 122 or a two-dimensional ("2-D") position fix based on measurements for three GPS satellites 122. A position fix is an estimate of the location of GPS antenna 304 and/or GPS receiver 406. GPS receiver 406 may determine a time of arrival ("TOA") for each GPS satellite 122, which is a measure of the time it takes for GPS signals 124*a*-124*n* (collectively 124) to travel from GPS satellites 122 to GPS receiver 406. GPS receiver 406 may then calculate the distance to each GPS satellite 122 based on the TOA for GPS satellites 122. GPS receiver 406 may then triangulate the position of vehicle 102 on Earth based on accurate distances to three GPS satellites 122 and the known locations of these satellites. Since GPS receiver 406 is typically not synchronized with GPS satellites 122, an additional measurement for either a fourth GPS satellite 122 or an Earth-bound base station is used to account for ambiguity in the timing of GPS receiver 406.

GSM 130 may be a TDMA system that may implement one or more TDMA standards such as, e.g., GSM. GSM 130 may include one or more Node B 134 and a radio network controller ("RNC") 132. Node B 134 provides over-the-air communication of GSM RF signals for GPS, GSM, and WLAN antenna 100 of vehicle 102 under its coverage area. RNC 132 couples to Node Bs in GSM 130 and provides coordination and control for one or more Node B 134. In general, Node B 134 is a fixed station that provides communication coverage for GPS, GSM, and WLAN antenna 100 of vehicle 102 and may also be referred to as base station(s) or some other terminology as would be understood by one of ordinary skill in the art. RNC 132 are network entities that provide coordination and control for the base stations and may also be referred to by some other terminology. Additionally, RNC 132 may also be in communication with a public switched telephone network ("PSTN") 136. Generally, GSM 130 is a cellular network and may include a plurality of Node B 134 and RNC 132 located in cells where vehicle 102 may travel. Node B 134 may transmit to and receive modulated RF signals 138 from GPS, GSM, and WLAN antenna 100 of vehicle 102.

WLAN system 140 includes one or more access points 144, such as an omni-directional antenna, multi-directional antenna, and/or directional antenna, for transmitting RF signals 148 to GPS, GSM, and WLAN antenna 100 of vehicle 102. Generally, access point 144 is in communication with a router 142 that is in communication with Internet 146 for transmitting and receiving data via RF signals 148 to GPS, GSM, and WLAN antenna 100 of vehicle 102. It should be noted that one of ordinary skill in the art will understand that WLAN system 140 has been simplified to better illustrate features of GPS, GSM, and WLAN antenna 100. Well-known elements have not been shown, but are nonetheless part of a network embodying features of GPS, GSM, and WLAN antenna 100. For example, one embodiment of WLAN system 140 may include amplifiers, power supplies, maintenance systems, gateways, additional routers, bridges, firewalls, and the like.

Figure 2:
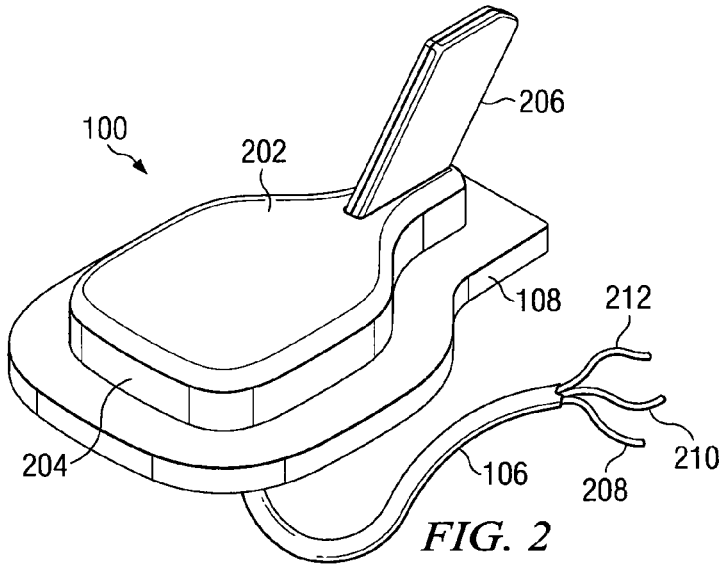
FIG. 2 is an illustration of a perspective view of an exemplary GPS, GSM, and WLAN antenna with cover according to one embodiment.
Figure 3A:
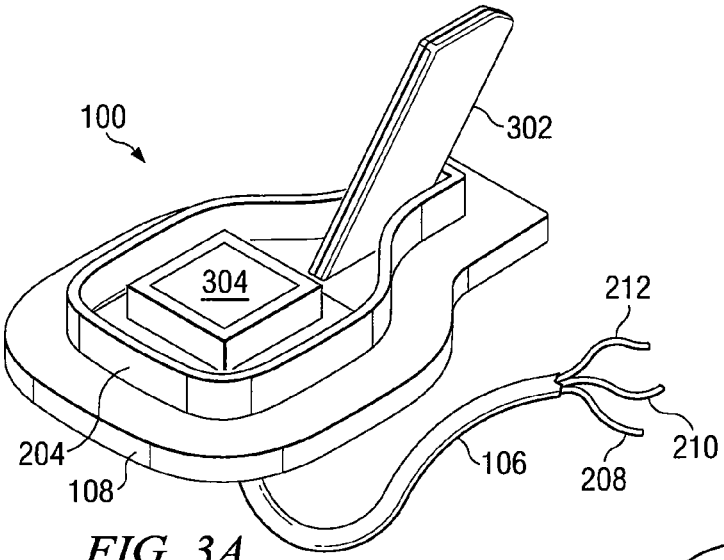
FIG. 3A is an illustration of a perspective view of the GPS, GSM, and WLAN antenna of FIG. 2 without cover according to one embodiment.
Figure 3B:
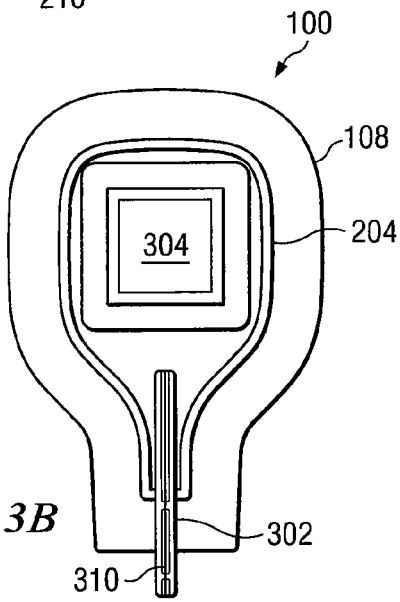
FIG. 3B is an illustration of a plan view of the GPS, GSM, and WLAN antenna of FIG. 3A according to one embodiment.
Figure 3C:
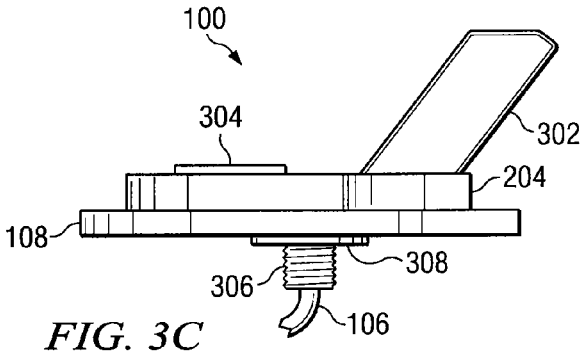
FIG. 3C is an illustration of a side view of the GPS, GSM, and WLAN antenna of FIG. 3A according to one embodiment.
Figure 3D:
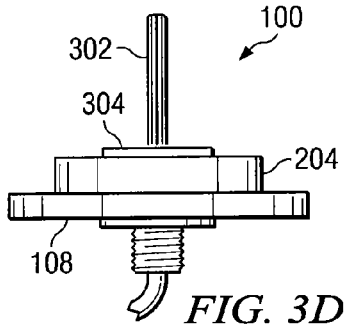
FIG. 3D is an illustration of a front view of the GPS, GSM, and WLAN antenna of FIG. 3A according to one embodiment.

Referring now to FIG. 2, an embodiment of GPS, GSM, and WLAN antenna 100 is shown with a cover 202, a housing or base 204, and a GSM/WLAN antenna housing 206, all preferably in sealing arrangement for protecting the electronics and antennas contained within as further described herein from the elements and weather. Generally, cover 202, base 204, and GSM/WLAN antenna housing 206 have a size, form, and/or shape sufficient to enclose the electronics and antennas contained within them. In one embodiment, base 204 has a size and shape sufficient to enclose GPS antenna 304 (FIG. 3) and the base portion of a GSM/WLAN antenna 302 (FIG. 3) as described herein. Additionally, GSM/WLAN antenna housing 206 has a size and shape sufficient to enclose the all or a portion of GSM/WLAN antenna 302 as described herein. In another embodiment, cover 202, base 204, and GSM/WLAN antenna housing 206 are a unified single piece and not separate individual pieces. Preferably, base 204 has a lower surface that joins in a sealing arrangement with the upper surface of roof 108 of vehicle 102. Additionally, conductor 106 may exit the lower surface of base 204 and be disposed through roof 108 as it is routed to transceiver 104, in one embodiment. In another embodiment, GPS, GSM, and WLAN antenna 100 may be affixed or attached to other portions of vehicle 102, such as pillars, windows, trunks, bodies, etc. Cover 202, base 204, and GSM/WLAN antenna housing 206 may be made out of a material that is weatherproof and dustproof while allowing the GPS antenna 304 and GSM/WLAN antenna 302 contained within GPS, GSM, and WLAN antenna 100 to operate without providing unnecessary interference with RF signals.

In one aspect, conductor 106 may include one or more separate conductors, wires, or cables, such as a radio frequency ("RF") cable 208, a RF cable 210, and a RF cable 212. RF cable 208 is for conducting signals between GPS receiver 406 (FIG. 4) and GPS, GSM, and WLAN antenna 100. RF cable 210 is for conducting signals between a WLAN receiver 404 (FIG. 4) and GPS, GSM, and WLAN antenna 100 and RF cable 212 is for conducting signals between a GSM receiver 402 (FIG. 4) and GPS, GSM, and WLAN antenna 100.

Referring now to FIGS. 3A-3D, an embodiment of GPS, GSM, and WLAN antenna 100 is shown with cover 202 and GSM/WLAN antenna housing 206 removed from base 204. A GSM/WLAN antenna 302 and GPS antenna 304 are disposed and/or positioned within base 204 of GPS, GSM, and WLAN antenna 100. Preferably, GSM/WLAN antenna 302 is a substantially planar PCB antenna having a combination GSM antenna and WLAN antenna traced on one or both sides of PCB antenna as further described below in FIGS. 5 and 6. Preferably, GSM/WLAN antenna 302 has one end that is secured to base 204 such that GSM/WLAN antenna 302 extends in an upward position to enable incident RF signals between GSM 130 and WLAN system 140 and GSM/WLAN antenna 302 of GPS, GSM, and WLAN antenna 100 to be effectively communicated. Also, GPS antenna 304 is positioned within base 204 such as in a substantially horizontal position such that it enables incident RF signals between GPS 120 and GPS antenna 304 of GPS, GSM, and WLAN antenna 100 to be effectively communicated.

In one embodiment, roof 108 has a hole or aperture therethrough (not shown) for receiving a threaded member 306 of base 204 for securing GPS, GSM, and WLAN antenna 100 to vehicle 102. In one aspect, a fastener, such as a nut or threaded washer 308 may be used with threaded member 306 for securing GPS, GSM, and WLAN antenna 100 to roof 108 of vehicle 102. Other types of fasteners, adhesives, and the like may be used to secure GPS, GSM, and WLAN antenna 100 to vehicle 102, as would be commonly known to those skilled in the art.

Figure 4A:
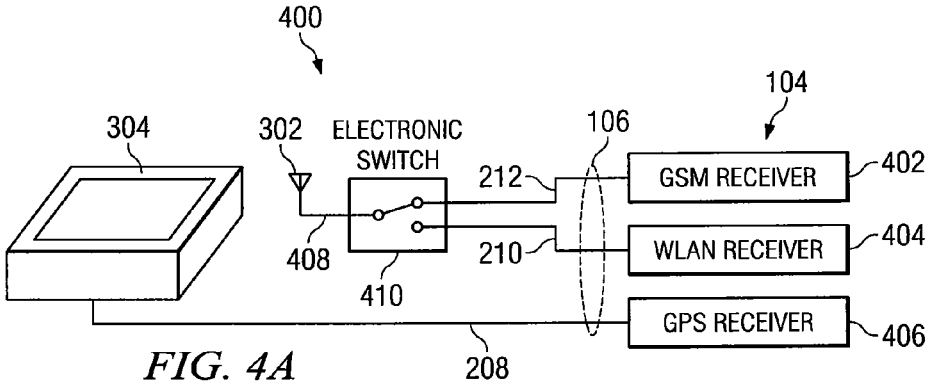
FIG. 4A is an illustration of an exemplary circuit of a GPS, GSM, and WLAN antenna according to one embodiment.

Referring now to FIG. 4A, an embodiment of an exemplary circuit 400 is shown that includes conductor 106 including RF cable 208, RF cable 210, and RF cable 212 in communication with GSM/WLAN antenna 302 and GPS antenna, respectively. RF cable 210 and RF cable 212 may be one RF cable 408 instead of two separate RF cables. In one embodiment, a switch 410 may switch the signals carried in conductor 408 to RF cable 210 and RF cable 212 to WLAN receiver 404 and GSM receiver 402, respectively. GSM receiver 402, WLAN receiver 404, and GPS receiver 406 may be part of transceiver 104 or they may be located separately or in different locations within vehicle 102. In another embodiment, one or more of RF cables 408, RF cable 208, switch 410, RF cable 210, and RF cable 212 may be housed fully or partially within GPS, GSM, and WLAN antenna 100. In yet another embodiment, one or more of switch 410, conductor 408, RF cable 208, RF cable 210, and RF cable 212 may be located fully or partially located within transceiver 104.

In general, GPS, GSM, and WLAN antenna 100 may be capable of communicating with any number of wireless systems of different wireless technologies, such as code division multiple access ("CDMA"), TDMA, GSM, GPS, WLAN, and the like. In one embodiment, the following describes the GPS, GSM, and WLAN antenna 100 communicating with GPS 120, GSM 130, and WLAN system 140. GPS, GSM, and WLAN antenna 100 may receive signals from one or more transmitting entities at any given moment, where a transmitting entity may be a base station, satellite, and the like; each transmitting entity may be received by each of the GSM/WLAN antenna 302 and GPS antenna 304 of GPS, GSM, and WLAN antenna 100, albeit at different amplitudes and/or phases.

Figure 4B:
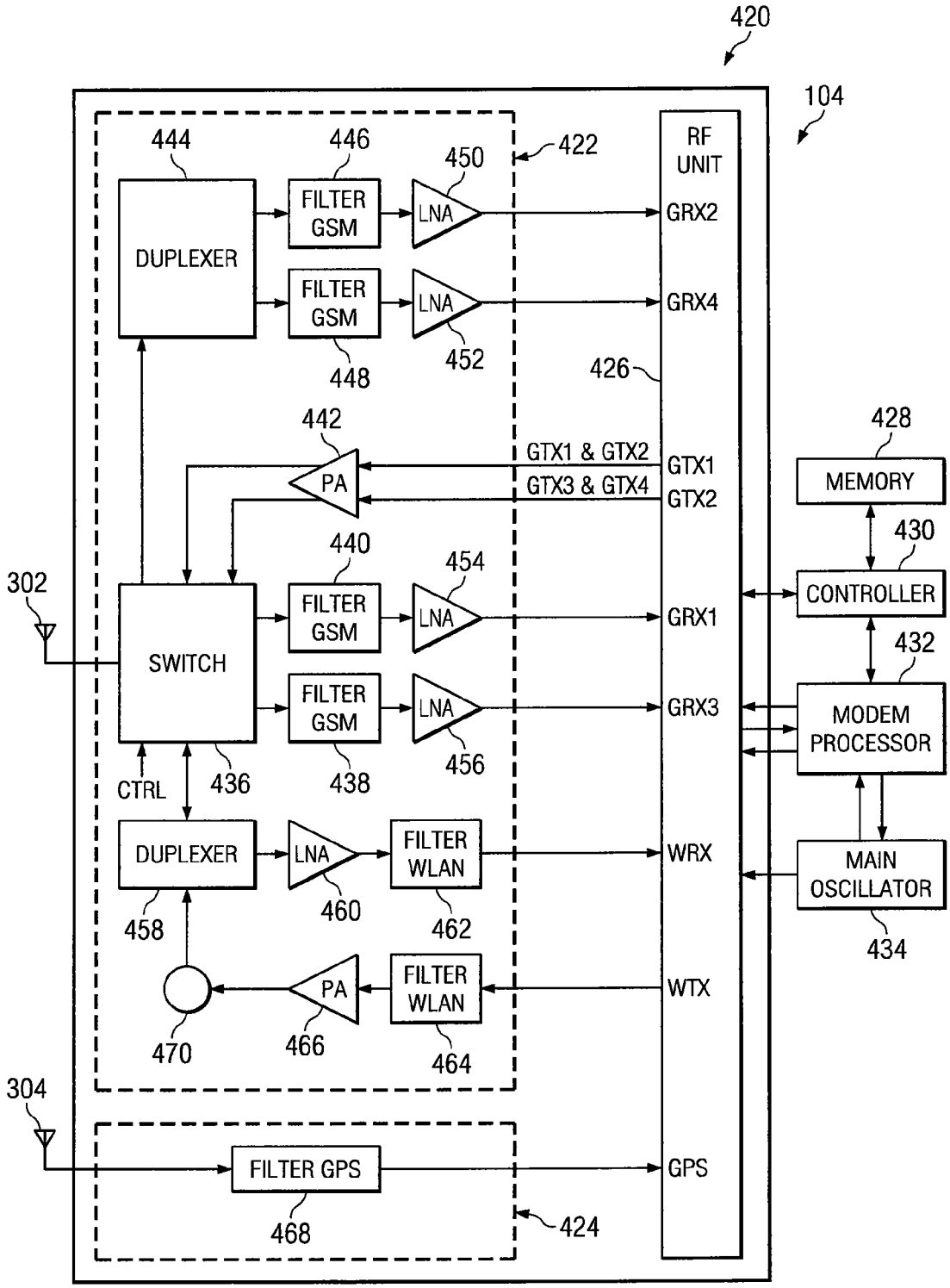
FIG. 4B is an illustration of an exemplary circuit of a GPS, GSM, and WLAN antenna according to another embodiment.

Referring now to FIG. 4B, another embodiment of an exemplary circuit 420 of transceiver 104 is described. As discussed above, GSM 130 and WLAN system 140 may operate on various frequency bands. For example, WLAN receiver 404 and GSM/WLAN antenna 302 may operate at 2.4 GHz range and GSM receiver 402 and GSM/WLAN antenna 302 may operate at 900 MHz and 1800 MHz; 850 MHz and 1900 MHz; and/or 2100 MHz range. GPS receiver 406 and GPS antenna 304 may operate at 1.57542 and/or 1.2276 GHz for example. For each frequency band, except for the GPS frequency band, one frequency range may be used for the downlink (i.e., forward link) from access point 144 and/or Node B 134 to GPS, GSM, and WLAN antenna 100, and another frequency range may be used for the uplink (i.e., reverse link) from GPS, GSM, and WLAN antenna 100 to access point 144 and Node B 134. As an example, for the GSM850/cellular band range (824-849 MHz) may be used for the uplink, and the 869 to 894 MHz range may be used for the downlink.

GPS, GSM, and WLAN antenna 100 may support one or multiple frequency bands for each of GPS 120, GSM 130, and WLAN system 140. In one embodiment, GPS, GSM, and WLAN antenna 100 communicates with one wireless system at a time, and in another embodiment, GPS, GSM, and WLAN antenna 100 communicates with more than one wireless system at a time. Various embodiments of circuit 420 of transceiver 104 of GPS, GSM, and WLAN antenna 100 are described.

Generally, GPS, GSM, and WLAN antenna 100 includes transceiver 104 that may support four frequency bands with receiving ("RX") diversity for TDMA for GSM and support four frequency bands with transmitting ("TX") diversity for TDMA for GSM. The quad GSM bands may include first, second, third, and fourth GSM transmit bands ("GTX1," "GTX2," "GTX3," "GTX4") and first, second, third, fourth GSM receive bands ("GRX1," "GRX2," "GRX3," "GRX4"). In addition, to these four frequency bands, transceiver 104 may support a WLAN frequency transmit band ("WTX") and a WLAN frequency receive band ("WRX"). Transceiver 104 may include a GSM/WLAN portion 422 that is in communication with GSM/WLAN antenna 302. In addition, transceiver 104 may include a GPS portion 424 that is in communication with GPS antenna 304. Additionally, GSM/WLAN portion 422 of transceiver 104 may include a switch 436 that may be switch 410 or another switch in addition to switch 410. GSM/WLAN portion 422 and GPS portion 424 may be in communication with a RF unit 426, which may condition signals for GSM/WLAN portion 422. Switch 436 may be a transmit/receive T/R switch that has one or more common RF port in communication with GSM/WLAN antenna 302.

Further, switch 436 may be in communication with a duplexer 458 for the WRX and WTX paths. Switch 436 may further include two input RF ports for the four GSM transmit paths, GTX1-GTX4. Switch 436 may also include two output RF ports for the GMS receive paths, GRX1 and GRX2. Switch 436 couples the common RF port to one of the I/O RF ports at any given moment based on a control signal ("CTRL"), which may be a single-bit or multi-bit signal. For GSM, which may be a time division duplex ("TDD") system, uplink and downlink transmissions occur in different non-overlapping time intervals or time slots, and only the transmit path or the receive path may be active at any given moment. Switch 436 performs switching to allow GSM/WLAN portion 422 to process either GSM or WLAN signals. Additionally, switch 436 further performs switching between the GSM transmit and receive paths when GSM/WLAN portion 422 is processing GSM.

The GSM transmit path includes a power amplifier ("PA") module 442 that receives and amplifies a GSM transmit signal (GTX1-GTX4) from RF unit 426 and provides a GSM uplink signal for transmission via GSM/WLAN antenna 302. PA module 442 may have a variable gain that may be adjusted based on a gain control signal, which may come from a modem processor 432. The gain control signal may ramp-up or ramp-down the gain of PA module 442. The amplitude of the GSM uplink signal may also be controlled by the gain control signal and the phase of the GSM uplink signal may be controlled by modem processor 432 to achieve any modulation, such as Gaussian minimum-shift keying ("GMSK"), phase-shift keying ("PSK"), offset quadrature phase-shift keying ("OQPSK"), quadrature amplitude modulation ("QAM"), and the like. The GSM transmit and receive paths may be designed to be compliant with GSM system requirements described in 3GPP TS 51.010, which is publicly available, for example.

The first and third GSM receive paths, GRX1 and GRX3, may each include a GMS filter 440 and 438, respectively, that filters a received signal from GSM/WLAN antenna 302 and a low noise amplifier ("LNA") 454 and 456, respectively, that amplifies the filtered signal from filters 440 and 438 and provides GSM received signals (GRX1 and GRX3) to RF unit 426. GSM filters 440 and 438 may be bandpass filters that are implemented with a surface acoustic wave ("SAW") filter having a bandwidth equal to the first or second GSM receive signals (GRX1 and GRX3). Also, GSM filters 440 and 438 may filter out large amplitude undesired signals (or "jammers") and other out-of-band signals transmitted by other wireless systems.

The WLAN transmit path includes a filter 464, a power amplifier 466, and an isolator 470. Filter 464 filters a WTX from RF unit 426 and provides a filtered WLAN signal. Filter 464 may be implemented with a SAW filter having a bandwidth equal to the WLAN transmit band. Power amplifier 466 amplifies the filtered WLAN signal and provides a WLAN uplink signal. Isolator 470 couples the WLAN uplink signal to duplexer 458 and prevents the signal from duplexer 458 from coming back to power amplifier 466, and provides an impedance load for power amplifier 466. Duplexer 458 routes the WLAN uplink signal from isolator 470 to switch 436 for transmission via GSM/WLAN antenna 302.

Duplexer 458 also receives, via switch 436, the received signal from GSM/WLAN antenna 302 and routes the received signal to the WLAN receive path. Duplexer 458 provides isolation between the transmit path and the main receive path for WLAN, filters out undesired signal components for each of these two paths, and supports simultaneous operation of these two signal paths for full-duplex communication. The WRX path includes a LNA 460 and a filter 462. LNA 460 amplifies the received signal from GSM/WLAN antenna 302 and provides an amplified received signal. Filter 462 filters the amplified received signal and provides a WRX to RF unit 426. Filter 462 may be implemented with a SAW filter having a bandwidth equal to the WLAN receive band, WRX. Duplexer 458 performs filtering to preselect the WRX band and filter 462 provides additional filtering to remove leakage of the WLAN uplink signal coming from the WLAN transmit path.

RF unit 426 performs signal conditioning for GSM and WLAN signals for all of the transmit and receive paths. For each GSM received signal and each WLAN received signal, RF unit 426 may perform frequency down-conversion, demodulation, filtering, amplification, and gain control. For each GSM transmit signal and each WLAN transmit signal, RF unit 426 may perform filtering, amplification and gain control, modulation, and frequency up-conversion. RF unit 426 may utilize a super-heterodyne architecture or a direct-conversion architecture. The super-heterodyne architecture may use multiple stages, such as frequency down-conversion from RF to an intermediate frequency ("IF") in one stage, and (e.g., quadrature) demodulation from IF to baseband in another stage. The direct-conversion architecture uses a single stage to perform demodulation and frequency down-conversion from RF directly to baseband. Similarly, modulation and frequency up-conversion are performed in multiple stages for the super-heterodyne architecture and in a single stage for the direct-conversion architecture. RF unit 426 also performs modulation and demodulation for each wireless system based on the modulation scheme employed by that system and using techniques known in the art. For example, modulation for GSM may be performed with an offset phase locked loop ("OPLL") or a polar modulation scheme.

Additionally, GSM/WLAN portion 422 may include a diplexer 444 that couples to GSM/WLAN antenna 302, obtains the received signal from GSM/WLAN antenna 302, provides first and second diplexer output signals to the second and fourth GSM receive paths (GRX2 and GRX4), respectively. The second GSM receive path includes a filter 446 and an LNA 450 that filter and amplify the first diplexer output signal and provide a second GSM received signal (GRX2) to RF unit 426. The fourth GSM receive path (GRX4) includes a filter 448 and an LNA 452 that filter and amplify the second diplexer output signal and provide a fourth GSM received signal (GRX4) to RF unit 426. Filters 446 and 448 may be SAW filters having bandwidths equal to the second and fourth GSM receive bands, respectively.

A modulator/demodulator ("modem") processor 432 performs baseband modem processing for GSM and WLAN. For each transmit path, modem processor 432 encodes, interleaves, and modulates data to obtain data symbols, which are modulation symbols for data. Modem processor 432 further performs physical layer processing on the data symbols and pilot symbols, which are modulation symbols for a pilot, in accordance with the wireless system. For example, modem processor 432 may channelize (or "cover") and spectrally spread (or "scramble") the data and pilot symbols to obtain data chips. For each receive path, modem processor 432 performs the complementary physical layer processing (e.g., spectral despreading and dechannelization) to obtain received symbols, and further demodulates, deinterleaves, and decodes the received symbols to obtain decoded data. The modem processing for GSM is described in 3GPP TS 05 documents, and the modem processing for WLAN is dependent on the WLAN standard being implemented, such as IEEE 802.11a/b/g/n. Modem processor 432 also performs analog-to-digital conversion for each receive path and digital-to-analog conversion for each transmit path. Although not shown in FIG. 4B, modem processor 432 may also interface with a memory unit 428, multimedia units (e.g., a camera), I/O units (e.g., a touch screen, a display unit, a keypad, a speaker, and/or a microphone), and the like. Modem processor 432 may be implemented with one or more application specific integrated circuits ("ASICs").

A main oscillator 434 provides a reference oscillator signal (at a predetermined frequency) to RF unit 426 and modem processor 432. Main oscillator 434 may be implemented with a voltage-controlled temperature-compensated crystal oscillator ("VCTCXO") or some other types of oscillator known in the art. RF unit 426 may include built-in voltage-controlled oscillators ("VCOs") and phase locked loops ("PLLs"). One set of VCO and PLL may be used for each signal path that may be "tuned" (i.e., adjusted in frequency) independently. Each set of VCO and PLL receives the reference oscillator signal from main oscillator 434 and generates a local oscillator ("LO") signal at the desired frequency. A controller 430 controls the operation of modem processor 432 and possibly RF unit 426. Memory 428 provides storage for controller 430 and modem processor 432.

Additionally, transceiver 104 may include a GPS portion 424 that supports GPS signals. GPS portion 424 includes a filter 468 that is in communication with GPS antenna 304 for GPS, filters a received signal from GPS antenna 304, and provides a GPS received signal to RF unit 426. GPS antenna 304 may be designed for one or more GPS bands, such as 1.227 GHz and/or 1.575 GHz, as further described below with reference to FIG. 7. Filter 468 may be implemented with a SAW filter having a bandwidth equal to the GPS band, for example.

Figure 5:
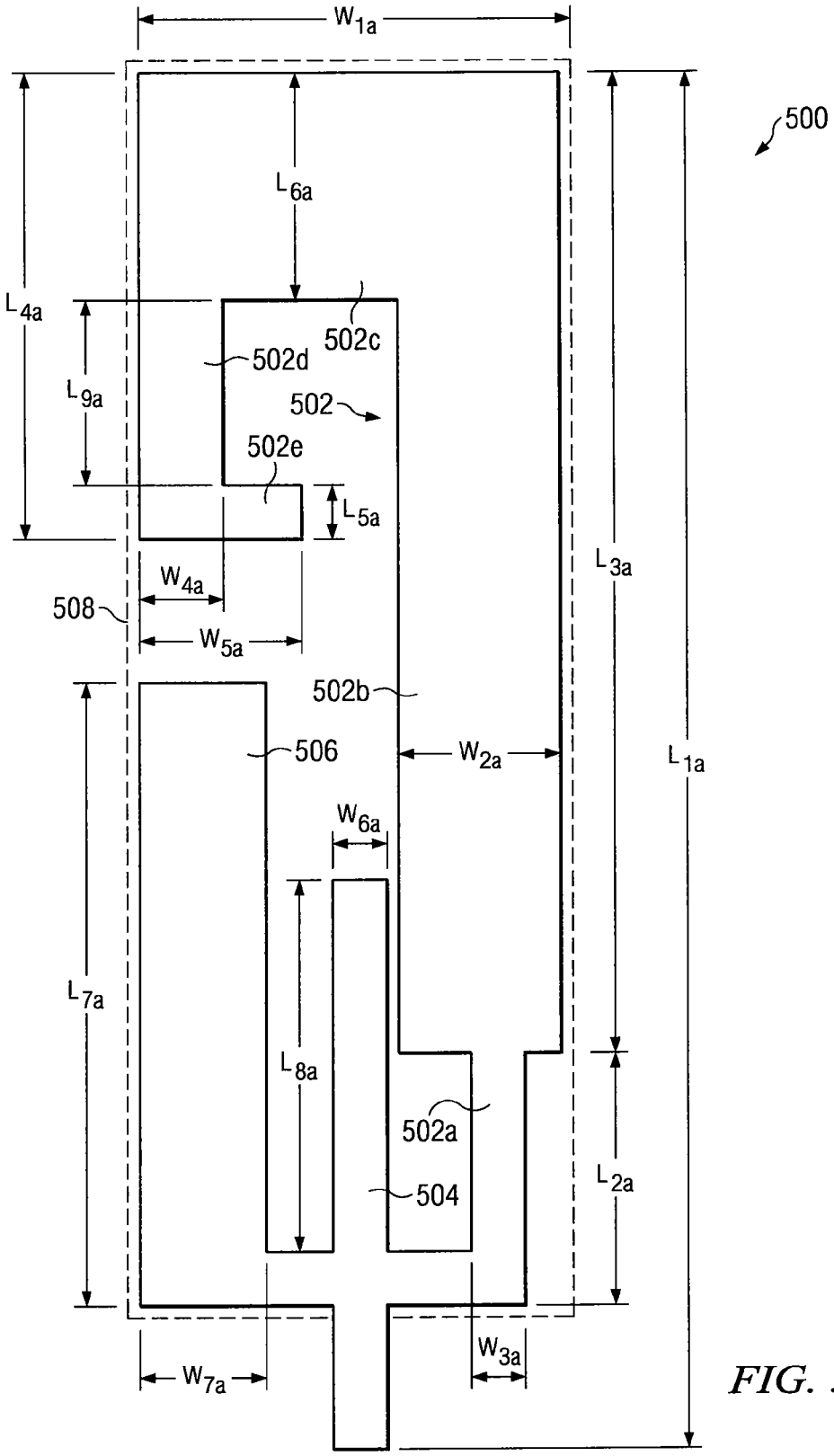
FIG. 5 is an illustration of a plan view of a combination printed GSM meander antenna and printed WLAN meander antenna according to one embodiment.

Referring now to FIG. 5, an illustration of a plan view of an embodiment of a GSM/WLAN printed meander antenna 500 having different widths and lengths are shown. In one aspect, GSM/WLAN printed meander antenna 500 is printed on a PCB 508. In FIG. 5, GSM/WLAN printed meander antenna 500 is shown with a GSM printed meander antenna portion 502, 506, and WLAN printed meander antenna portion 504. GSM printed meander antenna portion 502, 506 and WLAN printed meander antenna portion 504 may be connected to transceiver 104 via conductor 106. GSM printed meander antenna portion 502, 506 and WLAN printed meander antenna portion 504 are printed on one side or both sides of PCB 508. GSM printed meander antenna portion 502, 506 and WLAN printed meander antenna portion 504 may further include an inductor (not shown) disposed between them for additional impedance tuning of GSM/WLAN printed meander antenna 500. In one embodiment, GSM/WLAN printed meander antenna 500 may further include a resistor (not shown) for providing additional frequency bandwidth.

In one embodiment, GSM printed meander antenna portion 502 may include a antenna trace line antenna trace line 502*a*, antenna trace line 502*b*, antenna trace line 502*c*, antenna trace line 502*d*, and antenna trace line 502*e* (collectively 502). Antenna trace lines 502*a* and 502*b* may have a length $L_{1a}$ from about 84 millimeters ("mm") to about 28 mm. In another aspect, antenna trace lines 502*a* and 502*b* may have a length $L_{1a}$ from about 70 mm to about 42 mm. Preferably, antenna trace lines 502*a* and 502*b* may have a length $L_{1a}$ of 56 mm. Antenna trace line 502*a* may have a length $L_{2a}$ from about 15 mm to about 5 mm. In another aspect, antenna trace line 502*a* may have a length $L_{2a}$ from about 13 mm to about 8 mm. Preferably, antenna trace line 502*a* may have a length $L_{2a}$ of 10 mm. Additionally, antenna trace line 502*a* may have a width $W_{3a}$ from about 3 mm to about 1 mm. In another aspect, antenna trace line 502*a* may have a width $W_{3a}$ from about 3 mm to about 2 mm. Preferably, antenna trace line 502*a* may have a width $W_{3a}$ of 2 mm.

In one aspect, antenna trace line 502*b* has a length $L_{3a}$ of from about 60 mm to about 20 mm. In another aspect, antenna trace line 502*b* has a length $L_{3a}$ of from about 50 mm to about 30 mm. Preferably, antenna trace line 502*b* has a length $L_{3a}$ of 40 mm. Antenna trace line 502*b* has a width $W_{2a}$ of from about 10 mm to about 3 mm. In one aspect, antenna trace line 502*b* has a width $W_{2a}$ of from about 8 mm to about 5 mm. Preferably, antenna trace line 502*b* has a width $W_{2a}$ of 7 mm.

In one aspect, antenna trace line 502*c* has a length $L_{6a}$ of from about 13 mm to about 4 mm. In another aspect, antenna trace line 502*c* has a length $L_{6a}$ of from about 11 mm to about 7 mm. Preferably, antenna trace line 502*c* has a length $L_{6a}$ of 9 mm. Antenna trace line 502*c* has a width $W_{1a}$ of from about 26 mm to about 9 mm. In one aspect, antenna trace line 502*c* has a width $W_{1a}$ of from about 21 mm to about 13 mm. Preferably, antenna trace line 502*c* has a width $W_{1a}$ of 17 mm. Additionally, the combined length of antenna trace line 502*d* and antenna trace lines 502*e* has a length $L_{4a}$ of from about 29 mm to about 10 mm. In another aspect, the combined length of antenna trace line 502*d* and antenna trace lines 502*e* has a length $L_{4a}$ of from about 24 mm to about 14 mm. Preferably, antenna trace line 502*d* and antenna trace lines 502*e* has a length $L_{4a}$ is 19 mm.

In one aspect, antenna trace line 502*d* has a length $L_{9a}$ of from about 12 mm to about 4 mm. In another aspect, antenna trace line 502*d* has a length $L_{9a}$ of from about 10 mm to about 6 mm. Preferably, antenna trace line 502*d* has a length $L_{3a}$ of 8 mm. Antenna trace line 502*d* has a width $W_{4a}$ of from about 5 mm to about 2 mm. In one aspect, antenna trace line 502*d* has a width $W_{4a}$ of from about 4 mm to about 3 mm. Preferably, antenna trace line 502*d* has a width $W_{4a}$ of 3 mm.

In one aspect, antenna trace line 502*e* has a length $L_{5a}$ of from about 3 mm to about 1 mm. In another aspect, antenna trace line 502*e* has a length $L_{5a}$ of from about 3 mm to about 2 mm. Preferably, antenna trace line 502*e* has a length $L_{3a}$ of 2 mm. Antenna trace line 502*e* has a width $W_{5a}$ of from about 9 mm to about 3 mm. In one aspect, antenna trace line 502*e* has a width $W_{5a}$ of from about 8 mm to about 5 mm. Preferably, antenna trace line 502*e* has a width $W_{5a}$ of 6 mm.

In one aspect, antenna trace line of WLAN printed meander antenna portion 504 ("antenna trace line 504") has a length $L_{8a}$ of from about 23 mm to about 8 mm. In another aspect, antenna trace line 504 has a length $L_{8a}$ of from about 19 mm to about 11 mm. Preferably, antenna trace line 504 has a length $L_{8a}$ of 15 mm. Antenna trace line 504 has a width $W_{6a}$ of from about 7 mm to about 2 mm. In one aspect, antenna trace line 504 has a width $W_{6a}$ of from about 6 mm to about 4 mm. Preferably, antenna trace line 504 has a width $W_{6a}$ of 5 mm.

In one aspect, GSM printed meander antenna portion 506 ("antenna trace line 506") has a length $L_{7a}$ of from about 37 mm to about 12 mm. In another aspect, antenna trace line 506 has a length $L_{7a}$ of from about 31 mm to about 19 mm. Preferably, antenna trace line 506 has a length $L_{7a}$ of 25 mm. Antenna trace line 506 has a width $W_{7a}$ of from about 8 mm to about 3 mm. In one aspect, antenna trace line 506 has a width $W_{7a}$ of from about 6 mm to about 4 mm. Preferably, antenna trace line 506 has a width $W_{7a}$ of 5 mm.

In one embodiment, antenna trace line 502*a* and antenna trace line 502*b* extend laterally or vertically from the lower end of PCB 508 to the upper end of PCB 508. In this embodiment, antenna trace line 502*c* may extend longitudinally or horizontally from one side of antenna trace line 502*c* towards the other side of PCB 508 as shown. Further, antenna trace line 502*d* may extend laterally or vertically from the upper end of PCB 508 towards the lower end of PCB 508. Antenna trace line 502*e* may extend longitudinally or horizontally from one end of antenna trace line 502*d* towards antenna trace line 502*b*. In one embodiment, WLAN printed meander antenna portion 504 extends laterally or vertically from the lower end of PCB 508 toward the upper end of PCB 508, although it preferably terminates prior to antenna trace line 502*e*. Additionally, GSM printed meander antenna portion 506 also extends laterally or vertically from the lower end of PCB 508 toward the upper end of PCB 508, although it also preferably terminates prior to antenna trace line 502*e*.

In the representative embodiments described herein, terms such as "above," "below," "upper," "lower," etc., are used for convenience in referring to the accompanied drawings. In general, "above," "upper," "upward" and similar terms refer to a direction that is commonly thought of as vertically upward and the terms "below," "lower," and "downward" and similar terms refer to a direction in the opposite direction or vertically downward as commonly known. For purposes of this discussion, the relativity of these terms may be thought of in the context of the use and operation of the present GPS, GSM, and WLAN antenna 100. In one embodiment, the term "lower" may refer to the lower end of GPS, GSM, and WLAN antenna 100 that affixes to roof 108 of GPS, GSM, and WLAN antenna 100. Thus, the term "upper" may refer to the upper end of GPS, GSM, and WLAN antenna 100 that extends away from roof 108 of GPS, GSM, and WLAN antenna 100.

Figure 6:
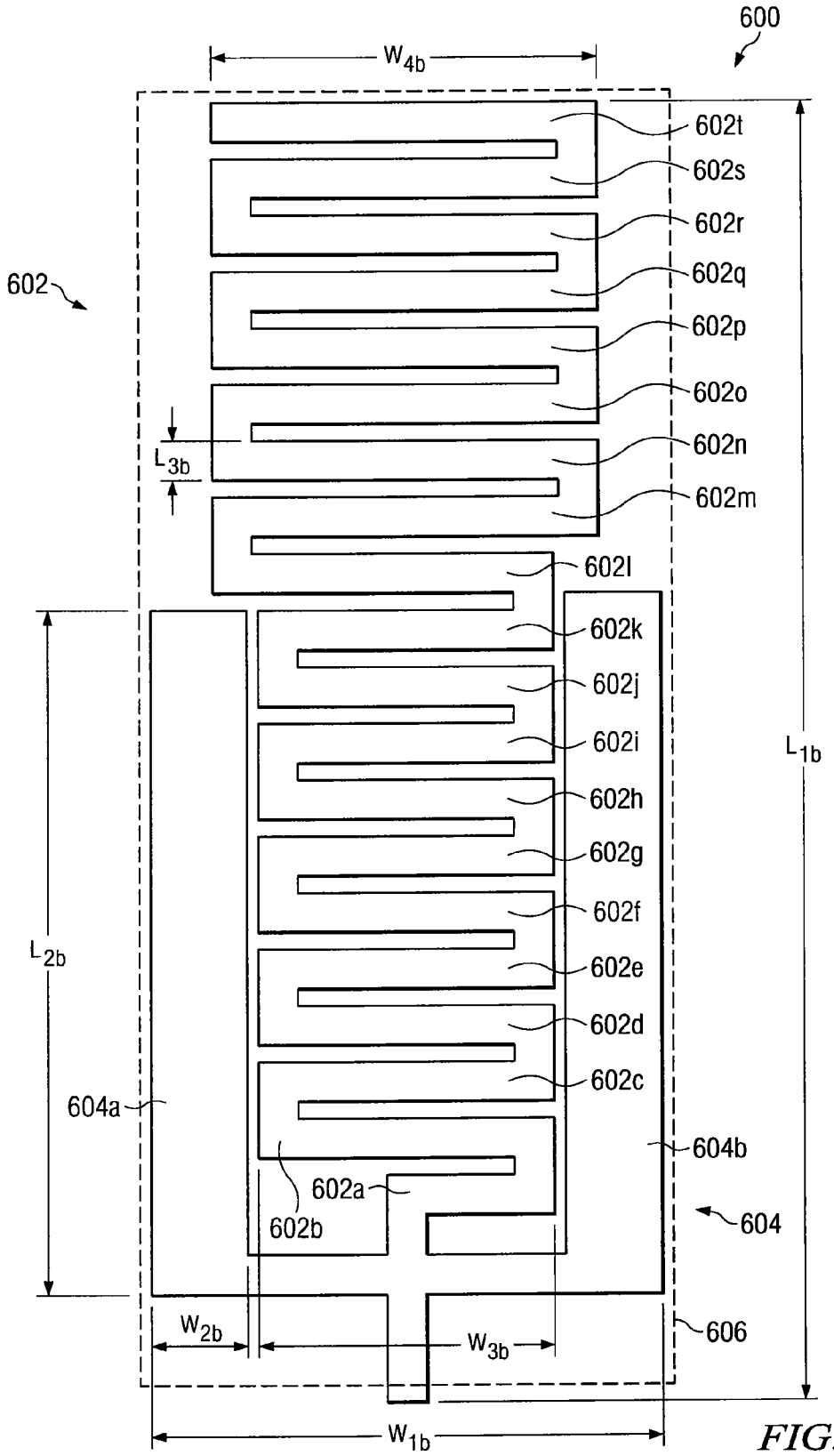
FIG. 6 is an illustration of a plan view of a combination printed GSM meander antenna and printed WLAN meander antenna according to another embodiment.

Referring to FIG. 6, an illustration of a plan view of another embodiment of a GSM/WLAN printed meander antenna 600 having different widths and lengths are shown. In one aspect, GSM/WLAN printed meander antenna 600 is printed on a PCB 606. In FIG. 6, GSM/WLAN printed meander antenna 600 is shown with a printed meander antenna portion 602 and printed meander antenna portions 604*a*, 604*b*. Printed meander antenna portion 602 and printed meander antenna portions 604*a*, 604*b* may be connected to transceiver 104 via conductor 106. Printed meander antenna portion 602 and printed meander antenna portion 604*a*, 604*b* are printed on one side or both sides of PCB 606. Printed meander antenna portion 602 and printed meander antenna portion 604*a*, 604*b* may further include an inductor (not shown) disposed between them for additional impedance tuning of GSM/WLAN printed meander antenna 600. In one embodiment, GSM/WLAN printed meander antenna 600 may further include a resistor (not shown) for providing additional frequency bandwidth.

In one embodiment, GSM printed meander antenna portion 602 may each include 20 longitudinal or horizontal antenna trace lines of GSM printed meander antenna portion 602, 602*a*-602*t* (collectively 602). In one embodiment, antenna trace lines 602 may have a length $L_{1b}$ from about 104 mm to about 35 mm. In another aspect, antenna trace lines 602 may have a length $L_{1b}$ from about 86 mm to about 52 mm. Preferably, antenna trace lines 602 may have a length $L_{1b}$ from about 86 mm is 69 mm. The length $L_{1b}$ includes all the bends of the antenna trace lines 602. In one aspect, printed meander antenna portion 602 and printed meander antenna portions 604*a*, 604*b* may have a width $W_{1b}$ from about 39 mm to about 13 mm. In another aspect, printed meander antenna portion 602 and printed meander antenna portions 604*a*, 604*b* may have a width $W_{1b}$ from about 32 mm to about 20 mm. Preferably, printed meander antenna portion 602 and printed meander antenna portions 604*a*, 604*b* may have a width $W_{1b}$ of 26 mm.

In one aspect, antenna trace lines 604*a* and 604*b* may have a length $L_{2b}$ from about 54 mm to about 18 mm. In another aspect, antenna trace lines 604*a* and 604*b* may have a length $L_{2b}$ from about 45 mm to about 27 mm. Preferably, antenna trace lines 604*a* and 604*b* have a length $L_{2b}$ of 36 mm. Antenna trace lines 604*a* and 604*b* may have a width $W_{2b}$ from about 8 mm to about 3 mm. Antenna trace lines 604*a* and 604*b* have a width $W_{2b}$ from about 6 mm to about 4 mm. Preferably, antenna trace lines 604*a* and 604*b* have a length $L_{2b}$ is 5 mm.

The individual antenna trace lines 602*a*-602*t* may have a length $L_{3b}$ from about 3 mm to about 1 mm. Further, individual antenna trace lines 602*a*-602*t* may have a length $L_{3b}$ from about 2 mm to about 1 mm. Preferably, individual antenna trace lines 602*a*-602*t* may have a length $L_{3b}$ of 2 mm. It may be common to consider $L_{3b}$ as a width of the entire printed meander antenna portion 602 in one embodiment although its dimensions are being provided as a length. As can be seen from FIG. 6, the widths of the individual antenna trace lines 602*a*-602*t* may vary. For example, the upper portion of printed meander antenna portion 602 is shown having a slightly wider width of individual antenna trace lines 602*a*-602*t* than the lower portion of printed meander antenna portion 602. In one aspect, the width $W_{3b}$ of individual antenna trace lines 602*a*-602*t* may be from 23 mm to about 8 mm. In another aspect, the width $W_{3b}$ of individual antenna trace lines 602*a*-602*t* may from about 19 mm to about 12 mm. Preferably, the width $W_{3b}$ of individual antenna trace lines 602*a*-602*t* is 15 mm. Further, the width $W_{4b}$ of individual antenna trace lines 602*a*-602*t* may be from 30 mm to about 10 mm. Also, the width $W_{4b}$ of individual antenna trace lines 602*a*-602*t* may be from 25 mm to about 15 mm. Preferably, the width $W_{4b}$ of individual antenna trace lines 602*a*-602*t* is 20 mm. As shown, the upper portion of printed meander antenna portion 602 may have the width $W_{4b}$ and the lower portion of printed meander antenna portion 602 may have the width of $W_{3b}$.

In one embodiment, antenna trace lines 602*a*-602*t* may extend longitudinally or horizontally from the lower end of PCB 606 and meander back and forth substantially adjacent to each other as the entire length of printed meander antenna portion 602 extends towards the upper end of PCB 606. The printed meander antenna portions 604*a*, 604*b* may extend vertically or laterally from the lower end of PCB 606 towards the upper end of PCB 606 and may end at a point where the widths of 602*a*-602*t* increase in width. In one aspect, any or all of the trace lines described herein may be made from a conducting material, such as copper.

In one embodiment, symmetrical printed meander dipole antennas 600 and 700 may further include a ground spot that may be located on the bottom side of PCB 508 and 606, respectively, that may be used as a ground for the amplifier circuit when using GSM/WLAN printed meander antennas 500 and 600 in an active receiving embodiment. In one aspect, the lengths and number of bends of antenna trace lines 602*a*-602*t* may be chosen using electromagnetic software, such as IE3D, to provide a desirable resistance, such as 50 Ohms input impedance for a particular application. Additionally, impedance tuning may further be optimized by using inductors in addition to the additional cutting of the trace lines as described herein.

PCBs 508 and 606 may be a width that is desirable for a particular application. The width of the printed antenna trace lines may be any desired width for a particular application. PCBs 508 and 606 may further include a ground plane (not shown) with a dielectric board (not shown) disposed thereon. In one embodiment, the dielectric board of PCBs 508 and 606 may be composed of FR-4 material and have a thickness of approximately 1.6 mm and a relative permittivity of 4.4. It should be understood in the art that the configuration of the outputs of PCBs 508 and 606 may have alternative configurations and the dielectric board may be composed of another material and have a different thickness and provide an operable antenna solution. In one embodiment, ground pads are used as the second "arm" on each of these GSM/WLAN printed meander antenna 500 and GSM/WLAN printed meander antenna 600; the pads serve concomitantly as LNA grounds. The LNA located at the antenna trace line side may increase the sensitivity of a particular receiver as described herein, for example.

As further understood in the art, physical parameters of GSM/WLAN printed meander antennas 500 and 600 may be used for adjusting bandwidth to receive signals, such as RF signals, over a frequency band for tuning impedance of the antenna over the frequency band, and for adjusting gain over the bandwidth. If the output of the GSM/WLAN printed meander antennas 500 and 600 has a certain impedance that includes only resistive component (reactive component value is equal to), then if the RF circuit has the same input impedance, a voltage standing wave ratio ("VSWR") will have a value of 1.0 and the RF signal will be completely input into the RF circuit (i.e., no part of the RF signal will reflect back from the RF circuit). If the output impedance of GSM/WLAN printed meander antennas 500 and 600 and the input impedance of the RF circuit do not match, the VSWR increases to a multiple of 1.0, where the higher the ratio, the higher the VSWR and the lower the input of the RF input impedance of the RF circuit. In one embodiment, these fundamental RF principles may drive the configuration of GSM/WLAN printed meander antennas 500 and 600. Because slight differences in the configuration of GSM/WLAN printed meander antennas 500 and 600 can have large effects in tuning over the frequency range of a desired application(s), many configurations of the basic structure of GSM/WLAN printed meander antennas 500 and 600 may be used to provide RF output to any of the receivers described herein at a certain resistance (e.g., 50 Ohms) to match a resistance of an RF circuit (e.g., 50 Ohms).

In one embodiment, GPS antenna 304 is a single feed antenna that operates at 1.227 GHz frequency, and in another embodiment, GPS antenna 304 is a single feed antenna that operates at 1.575 GHz frequency. In another embodiment, GPS antenna 304 may be single feed dual band GPS antenna, which operates at both 1.227 GHz and 1.575 GHz frequencies. In both of these embodiments, GPS antenna 304 may be a single patch antenna or double patch antenna, for example.

Figure 7A:
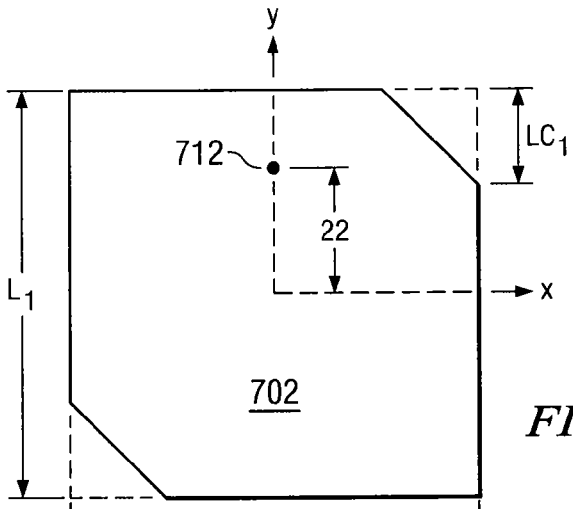
FIG. 7A is an illustration of top view of a top patch of a dual band GPS antenna of FIG. 7B according to one embodiment.
Figure 7B:
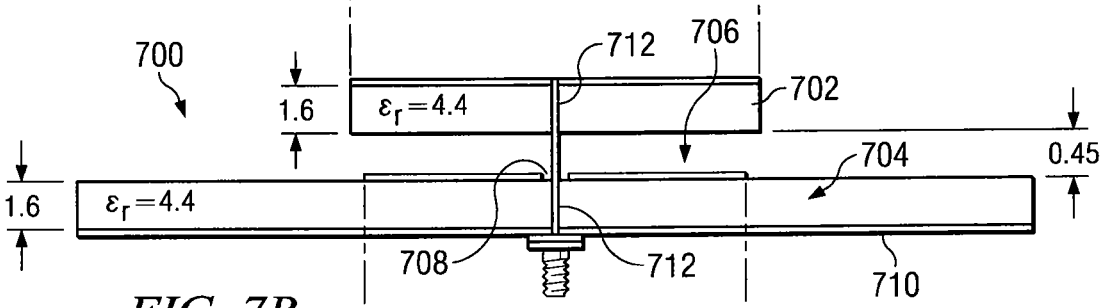
FIG. 7B is an illustration of a cross-section view of a dual band GPS antenna according to one embodiment.
Figure 7C:
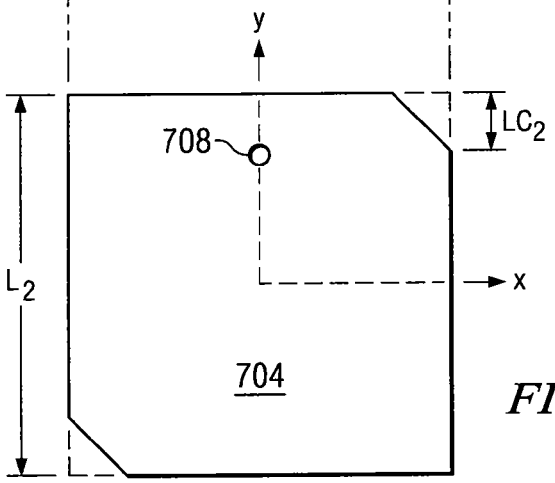
FIG. 7C is an illustration of a top view of a bottom patch of the dual band GPS antenna according to one embodiment.

Referring now to FIGS. 7A-7C, an embodiment of a single feed dual band GPS antenna 700 is shown. Dual band GPS antenna 700 includes a top patch antenna 702 and a bottom patch antenna 704. Dual band GPS antenna 700 is a single feed low-profile circularly polarized ("CP") microstrip antenna. Dual band GPS antenna 700 may be in place of GPS antenna 304 or in addition to GPS antenna 304 in GPS, GSM, and WLAN antenna 100. Dual band GPS antenna 700 operates in both the 1.227 GHz and 1.575 GHz frequencies. Top patch antenna 702 is substantially a square patch that is printed on FR4 substrate of thickness of 1.6 mm with a relative permittivity of 4.4. Top patch antenna 702 further includes a contact feed or probe feed 712 that excites top patch antenna 702 through a via 708 located in bottom patch antenna 704. Additionally, bottom patch antenna 704 may have a ground plane 710 disposed on the lower side of bottom patch antenna 704. In one aspect, ground plane 710 may have dimension of 100 mm by 100 mm. Probe feed 712 may be connected to RF cable 208 for providing signals to GPS receiver 406.

Located between top patch antenna 702 and bottom patch antenna 704 is a thin air layer 706. By varying the thickness of air layer 706, the frequency ratio of top patch antenna 702 and bottom patch antenna 704 can be varied. In one aspect, the resonant lengths $L_1$ and $L_2$, of top patch antenna 702 and bottom patch antenna 704, respectively, may about the same, but not quite equal. They generally will depend on the lower CP frequency at 1.227 GHz. In one embodiment, to excite top patch antenna 702 at 1.227 GHz, it is preferred that the resonant $L_1$ be slightly larger than $L_2$. In one embodiment, $L_1$ is approximately 60 mm and is a square with opposing corners with a truncated side length $LC_1$, of 8.5 mm. Then another CP operation at the desired frequency of 1.575 GHz, bottom patch antenna 704 preferably has a resonant $L_2$ of approximately 59 mm and is square with opposing corners with a truncated side length $LC_2$ of 7.5 mm. Air layer 706 is preferably 0.45 mm. For bottom patch antenna 704, the obtained impedance bandwidth, determined from 10-db return loss, is 53 MHz, or about 4.3% with respect to 1.227 GHz. For top patch antenna 702, impedance bandwidth is 44 MHz, or about 2.8% referenced to 1.575 GHz.

Figure 8:
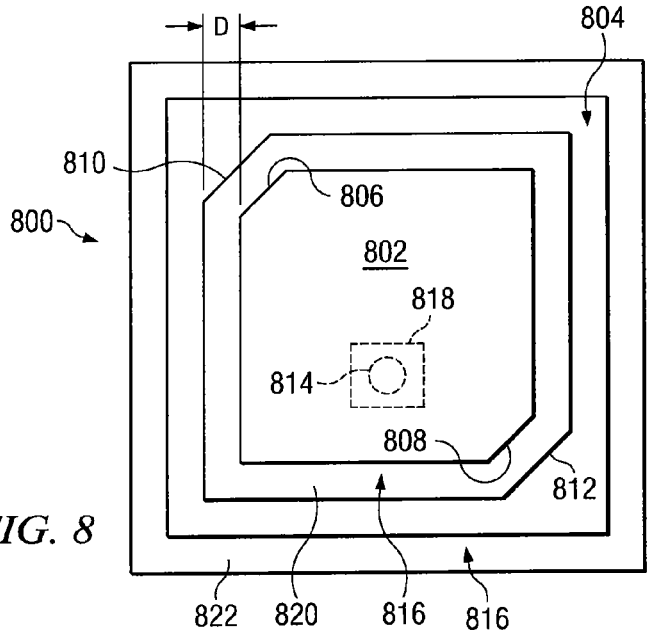
FIG. 8 is an illustration of a plan view of a GPS and satellite digital audio radio antenna according to one embodiment.

Referring to FIG. 8, an embodiment of a combination GPS and satellite digital audio radio antenna ("GPS SDAR antenna") 800. As noted above with respect to dual band GPS antenna 700, GPS SDAR antenna 800 may be used in place of GPS antenna 304 or in addition to GPS antenna 304. GPS signals 124 are right hand circular polarization ("RHCP") signals and SDARS are left hand circular polarization ("LHCP") signals, they may be operated at the same time without interfering with each other's passive performance. GPS SDAR antenna 800 may include a first top metallization element 802 and a second top metallization element 804 disposed over top surface of a dielectric material 14. First top metallization element 802 includes opposing cut corners 806, 808, which results in a LHCP polarized antenna element, and second top metallization element 804 includes straight-edge interior corners 810, 812 (i.e. non-perpendicular corners), which results in a RHCP polarized antenna element. A feed pin 814 is in direct contact with first top metallization element 802 and extends perpendicularly through the dielectric material 816 through an opening 818 formed in a substantially rectangular bottom metallization element (not shown). As illustrated, dielectric material 816 isolates the feed pin 814 from contacting the bottom metallization element.

Second top metallization 804 element is shaped as a substantially rectangular ring of material that encompasses a substantially rectangular sheet of material that defines first top metallization element 802. Each first and second top metallization elements 802, 804 may be separated by a ring 820 of dielectric material that may be integral with the dielectric material 816, which supports first and second top metallization elements 802, 804. Although first and second top metallization elements 802, 804 include a thickness, T, and are shown disposed in the top surface of dielectric material 816, first and second metallization elements 802, 804 may be placed over a top surface of dielectric material 816 and, as such, a separate ring 822 of dielectric material may be placed over the top surface of the dielectric material 816. In one aspect, an outer ring of dielectric material 822 may be placed over top surface to encompass an outer periphery of the second top metallization element 804. Additional disclosure relating to one embodiment of GPS SDAR antenna 800 are described in U.S. Pat. No. 7,253,770 issued Aug. 7, 2007 to Yegin et al; U.S. Pat. No. 7,405,700 issued Jul. 29, 2008 to Duzdar et al.; and U.S. Pat. No. 7,164,385 issued Jan. 16, 2007 to Duzdar et al.; which are all incorporated herein by reference in their entirety. GPS SDAR antenna 800 may be connected to GPS antenna 304 and satellite digital audio radio receiver (not shown) via RF cable 208 or other conductor means as commonly know to those skilled in the art.

Figure 9:
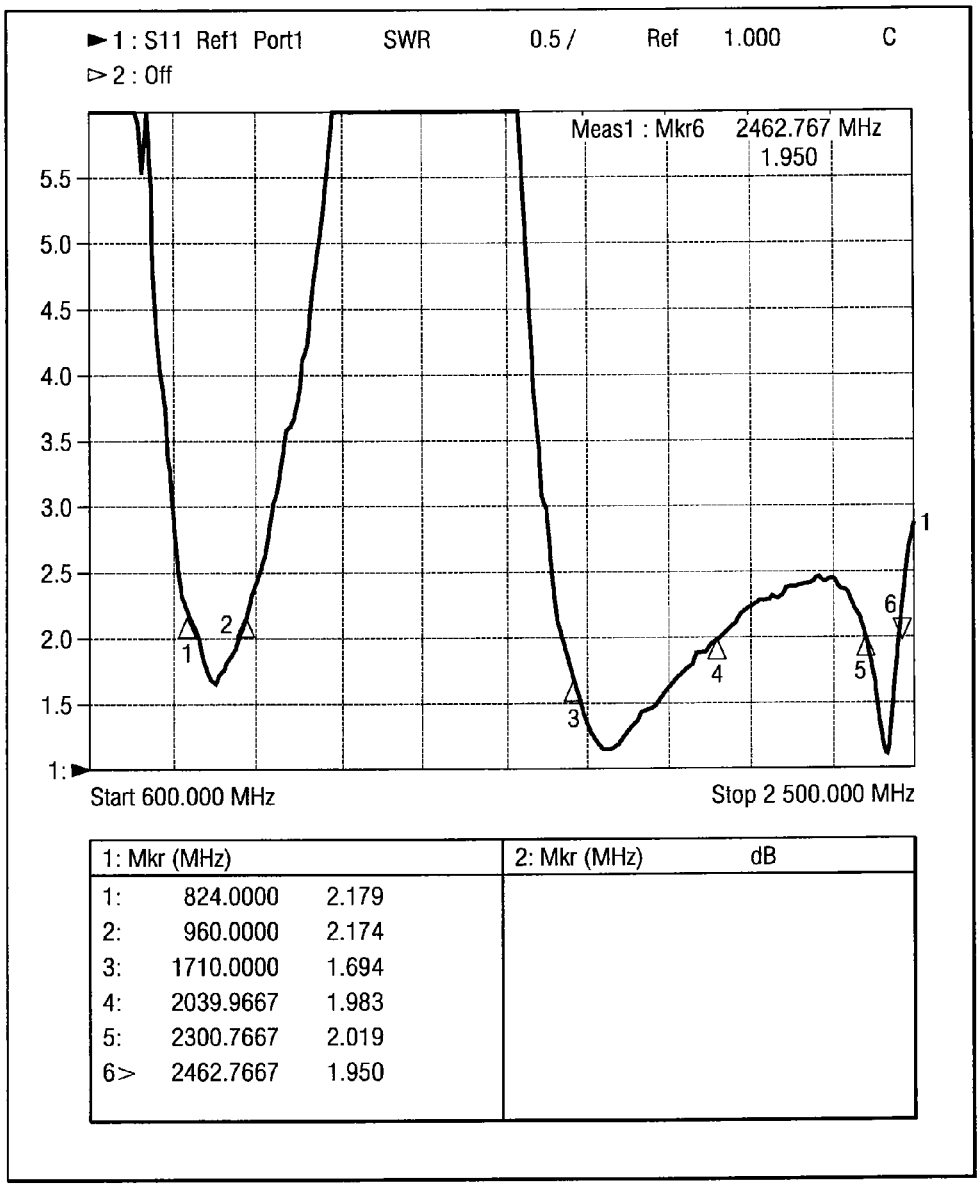
FIG. 9 illustrates a graph of the measurement of the combination printed GSM meander antenna and printed WLAN meander antenna of FIG. 5 according to one embodiment.
Figure 10:
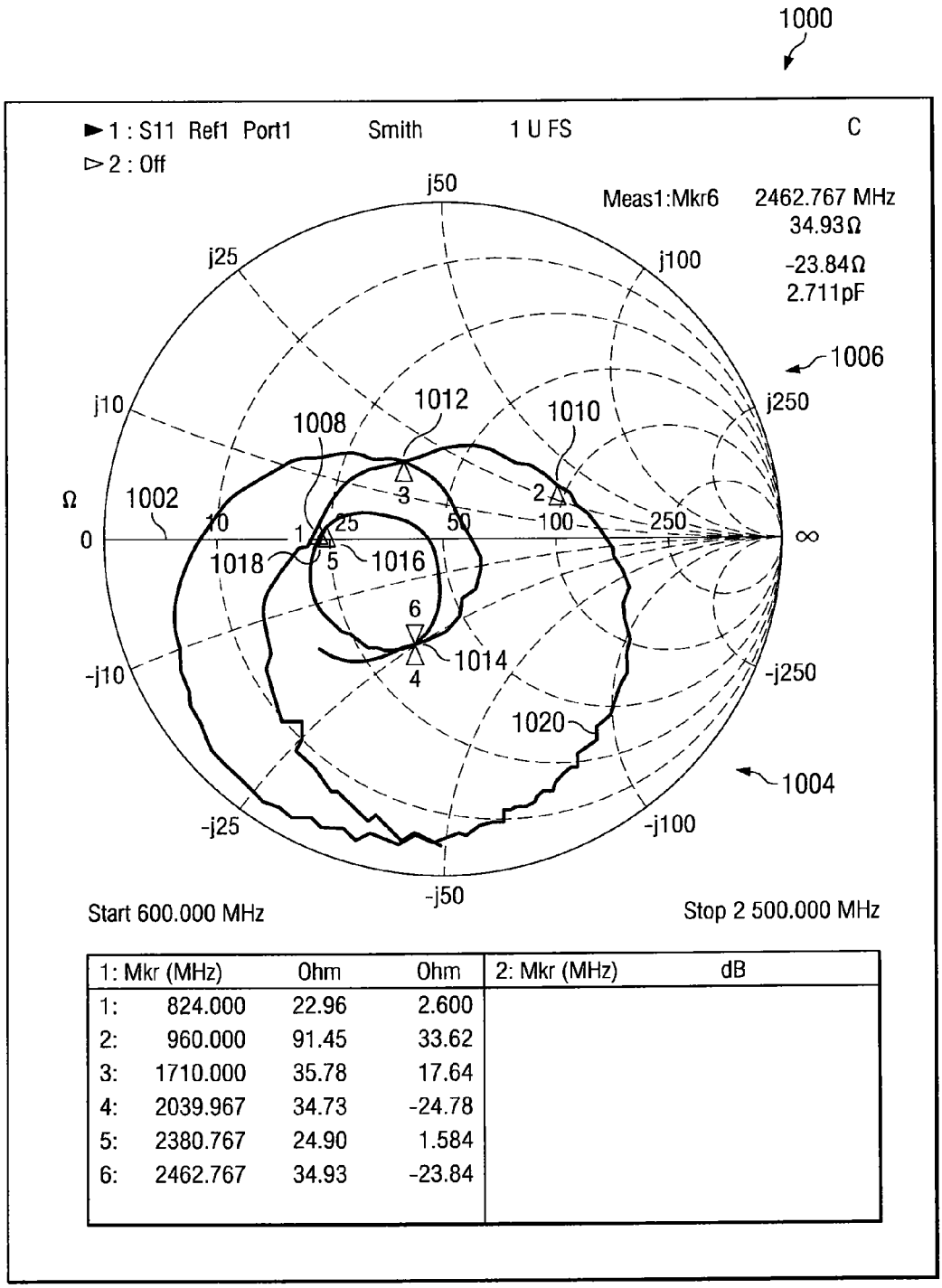
FIG. 10 is a Smith chart used for displaying an exemplary impedance plot that shows the impedance of combination printed GSM meander antenna and printed WLAN meander antenna of FIG. 5 according to one embodiment.

Referring to FIG. 9, a graph 900 shows a GSM/WLAN printed meander antenna 500 with resistance equal to 0 Ohms. As can be seen from graph 900, the measurement of the frequency bandwidth is approximately 1638.77 MHz, beginning at 824.0000 MHz and ending at 2462.7667 MHz. Referring to FIG. 10, a Smith chart 1000 is shown that is used for displaying an exemplary impedance plot 1020 for GSM/WLAN printed meander antenna 500. In designing a RF signal path, for example, a network analyzer that is capable of generating the Smith chart 1000 may be used to analyze impedances over a frequency range for operating GSM/WLAN printed meander antenna 500. As shown on the Smith chart 1000, the input impedance plot 1020 shows input impedances of GSM/WLAN printed meander antenna 500 having an impedance of 50 Ohms. Because GSM/WLAN printed meander antenna 500 and circuits 400 and 420 may be mismatched in impedance, a VSWR value is greater than 1 results. A Smith chart has a normalized impedance plane 1002 defining an inductive impedance (positive imaginary parts) 1006 above the normalized impedance plane 1002 and a capacitive impedances (negative imaginary parts) 1004 below the normalized impedance plane 1002. In Smith chart 1000, a marker 1008 shows an impedance or resistance of 22.96 Ohms at 824.000 MHz; a marker 1010 shows an impedance of 91.45 Ohms at 960.000 MHz; a marker 1012 shows an impedance of 35.78 Ohms at 1710.000 MHz; a marker 1014 shows an impedance of 34.73 Ohms at 2039.967 MHz; a marker 1016 shows an impedance of 24.90 Ohms at 2380.767 MHz; and a marker 1018 shows an impedance of 34.93 Ohms at 2462.767 MHz.

The previous detailed description is of a small number of embodiments for implementing the GPS, GSM, WLAN antenna and is not intended to be limiting in scope. One of skill in this art will immediately envisage the methods and variations used to implement this invention in other areas than those described in detail. The following claims set forth a number of the embodiments of the GPS, GSM, WLAN antenna disclosed with greater particularity.

What is claimed:

1. A Global Positioning System (GPS), Global System for Mobile Communications (GSM), wireless local area network (WLAN) antenna, comprising:

a dielectric board including a ground plane;

a first antenna trace line disposed on a first portion of the dielectric board and in electrical contact with the dielectric board, the first antenna trace line comprising:

at least one first meandered trace for transmitting and receiving a WLAN radio frequency signal;

a second antenna trace line disposed on a second portion of the dielectric board and in electrical contact with the dielectric board, the second antenna trace line comprising:

at least one second meandered trace for transmitting and receiving a GSM radio frequency signal;

a GPS antenna for receiving radio frequency signals from at least one global positioning satellite; and a vehicle mountable housing for enclosing the dielectric board, the first antenna trace line, the second antenna trace line, and the GPS antenna.

2. The GPS, GSM, WLAN antenna according to claim 1, further comprising:

a first output in contact with the first antenna trace line;

a second output in contact with the second antenna trace line; and a third output in contact with the GPS antenna for outputting electrical signals to at least one transceiver via a RF cable.

3. The GPS, GSM, WLAN antenna according to claim 2, further comprising:

a switch in contact with the first output and second output for switching between the GSM radio frequency signal and the WLAN radio frequency signal for providing the GSM radio frequency signal to a GSM transceiver and the WLAN radio frequency signal to a WLAN transceiver.

4. The GPS, GSM, WLAN antenna according to claim 1, wherein the transmitting and receiving of GSM radio frequency is time division multiple access.

5. The GPS, GSM, WLAN antenna according to claim 1, wherein the first antenna trace line is capable of receiving 900 MHz, 1800 MHz, 850 MHz, and 1900 MHz radio frequency signals.

6. The GPS, GSM, WLAN antenna according to claim 1, wherein the second antenna trace line is capable of receiving 2.4 GHz radio frequency signals.

7. The GPS, GSM, WLAN antenna according to claim 1, wherein the GPS antenna is capable of receiving one of 1.57542 GHz and 1.2276 GHz radio frequency signals.

8. The GPS, GSM, WLAN antenna according to claim 1, wherein the second antenna trace line comprises:

a first antenna trace line portion having a length of 10 mm and a width of 2 mm, the first antenna trace line portion extending laterally from a base of the housing;

a second antenna trace line portion having a length of 40 mm and a width of 7 mm, the second antenna trace line portion extending laterally from the first antenna trace line portion;

a third antenna trace line portion having a length of 9 mm and a width of 17 mm, the third antenna trace line portion extending substantially longitudinally from the second antenna trace line portion;

a fourth antenna trace line portion having a length of 8 mm and a width of 3 mm, the fourth antenna trace line portion extending laterally from the third antenna trace line portion towards the base of the housing; and a fifth antenna trace line portion having a length of 2 mm and a width of 3 mm, the fifth antenna trace line portion extending longitudinally from the fourth antenna trace line portion toward the first antenna trace line portion.

9. The GPS, GSM, WLAN antenna according to claim 1, wherein the first antenna trace line has a length of 24 mm and a width of 5 mm, the second antenna trace line extending laterally from a base of the housing.

10. The GPS, GSM, WLAN antenna according to claim 1, wherein the first antenna trace line comprises:

a first antenna trace line and a second antenna trace line spaced apart to define a first antenna portion between the first antenna trace line and the second antenna trace line, the first and second antenna trace line having a length of 36 mm and a width of 5 mm, the first and second antenna trace line extending laterally from a base of the housing.

11. The GPS, GSM, WLAN antenna according to claim 10, wherein the second antenna trace line comprises:

a first plurality of meander trace antenna lines disposed between the first antenna trace line and the second antenna trace line; and a second plurality of meander antenna trace lines not disposed between the first antenna trace line and the second antenna trace line, wherein the first plurality of meander trace antenna lines have a width of 15 mm and a length 2 mm, and the second plurality of meander trace antenna lines have a width of 20 mm and a length of 2 mm.

12. The GPS, GSM, WLAN antenna according to claim 1, wherein the dielectric board is a FR-4 dielectric substrate.

13. The GPS, GSM, WLAN antenna according to claim 1, further comprising:

a satellite digital audio radio antenna.

14. A vehicle having a Global Positioning System (GPS), Global System for Mobile Communications (GSM), wireless local area network (WLAN) antenna, comprising:

a vehicle body;

a dielectric board including a ground plane;

a first antenna trace line disposed on a first portion of the dielectric board and in electrical contact with the dielectric board, the first antenna trace line comprising:

at least one first meandered trace for transmitting and receiving a WLAN radio frequency signal;

a second antenna trace line disposed on a second portion of the dielectric board and in electrical contact with the dielectric board, the second antenna trace line comprising:

at least one second meandered trace for transmitting and receiving a GSM radio frequency signal;

a GPS antenna for receiving radio frequency signals from at least one global positioning satellite; and a housing mounted on the vehicle body for enclosing the dielectric board, the first antenna trace line, the second antenna trace line, and the GPS antenna.

15. The vehicle according to claim 14, further comprising:

a first output in contact with the first antenna trace line;

a second output in contact with the second antenna trace line; and a third output in contact with the GPS antenna for outputting electrical signals to at least one transceiver via a RF cable.

16. The vehicle according to claim 15, further comprising:

a switch in contact with the first output and second output for switching between the GSM radio frequency signal and the WLAN radio frequency signal for providing the GSM radio frequency signal to a GSM transceiver and the WLAN radio frequency signal to a WLAN transceiver.

17. The vehicle according to claim 14, wherein the transmitting and receiving of GSM radio frequency is time division multiple access.

18. The vehicle according to claim 14, wherein the first antenna trace line is capable of receiving 900 MHz, 1800 MHz, 850 MHz, and 1900 MHz radio frequency signals.

19. The vehicle according to claim 14, wherein the second antenna trace line is capable of receiving 2.4 GHz radio frequency signals.

20. The vehicle according to claim 14, wherein the GPS antenna is capable of receiving one of 1.57542 GHz and 1.2276 GHz radio frequency signals.

21. The vehicle according to claim 14, wherein the second antenna trace line comprises:

a first antenna trace line portion having a length of 10 mm and a width of 2 mm, the first antenna trace line portion extending laterally from a base of the housing;

a second antenna trace line portion having a length of 40 mm and a width of 7 mm, the second antenna trace line portion extending laterally from the first antenna trace line portion;

a third antenna trace line portion having a length of 9 mm and a width of 17 mm, the third antenna trace line portion extending substantially longitudinally from the second antenna trace line portion;

a fourth antenna trace line portion having a length of 8 mm and a width of 3 mm, the fourth antenna trace line portion extending laterally from the third antenna trace line portion towards the base of the housing; and a fifth antenna trace line portion having a length of 2 mm and a width of 3 mm, the fifth antenna trace line portion extending longitudinally from the fourth antenna trace line portion toward the first antenna trace line portion.

22. The vehicle according to claim 14, wherein the first antenna trace line has a length of 24 mm and a width of 5 mm, the second antenna trace line extending laterally from a base of the housing.

23. The vehicle according to claim 14, wherein the first antenna trace line comprises:

a first antenna trace line and a second antenna trace line spaced apart to define a first antenna portion between the first antenna trace line and the second antenna trace line, the first and second antenna trace line having a length of 36 mm and a width of 5 mm, the first and second antenna trace line extending laterally from a base of the housing.

24. The vehicle according to claim 23, wherein the second antenna trace line comprises:

a first plurality of meander trace antenna lines disposed between the first antenna trace line and the second antenna trace line; and a second plurality of meander antenna trace lines not disposed between the first antenna trace line and the second antenna trace line, wherein the first plurality of meander trace antenna lines have a width of 15 mm and a length 2 mm, and the second plurality of meander trace antenna lines have a width of 20 mm and a length of 2 mm.

25. The vehicle according to claim 14, wherein the dielectric board is a FR-4 dielectric substrate.

26. The vehicle according to claim 14, further comprising:

a satellite digital audio radio antenna.

* * * * *